United States Patent [19]

Benitz

[11] 4,078,593

[45] Mar. 14, 1978

[54] SLIDE MECHANISM FOR EXPANDABLE BIT SCREW HOLDING SCREWDRIVER

[76] Inventor: Earl Benitz, Box 106, Petersburg, Ak. 99833

[21] Appl. No.: 760,011

[22] Filed: Jan. 17, 1977

[51] Int. Cl.[2] ..... B25B 15/00

[52] U.S. Cl. ..... 145/50 E; 145/50 A

[58] Field of Search ..... 145/50 E, 50 R, 50 A

[56] References Cited

U.S. PATENT DOCUMENTS

| | | | |
|---|---|---|---|
| 1,647,343 | 11/1927 | Catron | 145/50 E |
| 2,445,383 | 7/1948 | Barlow | 145/50 E |
| 3,224,479 | 12/1965 | Osborn et al. | 145/50 E |

FOREIGN PATENT DOCUMENTS

| | | | |
|---|---|---|---|
| 222,808 | 12/1957 | Australia | 145/50 E |
| 166,083 | 6/1950 | Austria | 145/50 E |
| 359,716 | 10/1931 | United Kingdom | 145/50 E |

*Primary Examiner*—Al Lawrence Smith
*Assistant Examiner*—J. T. Zatarga
*Attorney, Agent, or Firm*—Christensen, O'Connor, Johnson & Kindness

[57] ABSTRACT

An expandable bit screw holding screwdriver comprising: an elongated shank having a handle end and a blade end; and, a slide coaxially mounted on the shank, is disclosed. The blade end is formed by the tips of a pair of shank elements movable between a position whereat the elements diverge outwardly in their facing plane and a position whereat the elements diverge less and may become generally aligned. Intermediate the handle end and the blade end, the shank includes a helical path formed in its outer periphery. The slide includes longitudinally spaced, shaped apertures. Preferably, the shaped apertures have long and short axes that are angularly displaced with respect to one another about the longitudinal axis of the slide. Coaction between one aperture and the outer surface of the diverging shank elements, as the other aperture follows the helical path and causes the slide to rotate, move the shank elements between their two positions. The cross-sectional configuration of the shank elements, the helical path and the shaped apertures can take on a variety of shapes. In one form, the helical path is formed by a twist in the shank elements and the elements diverge outwardly from the twist in a direction such that the elements remain in contact in the region of twist regardless of the position of the slide along the longitudinal length of the shank. In an alternate form, the helical path is formed in a separate guide member and the shank elements extend coaxially outwardly from the guide member. Preferably, a stop mechanism prevents the slide from sliding off of the blade end.

30 Claims, 28 Drawing Figures

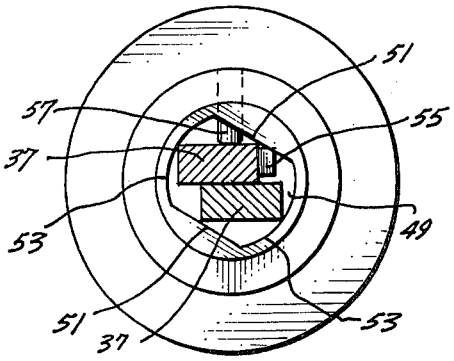
Fig. 2.
Fig. 3.
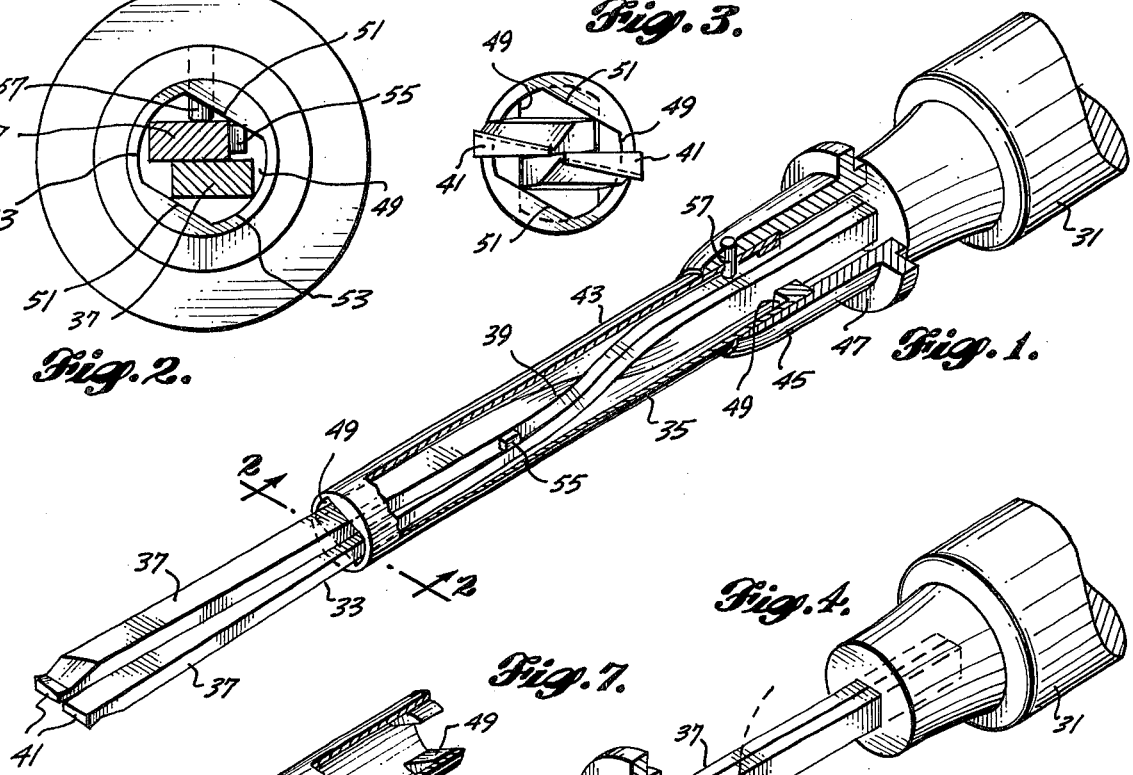
Fig. 1.
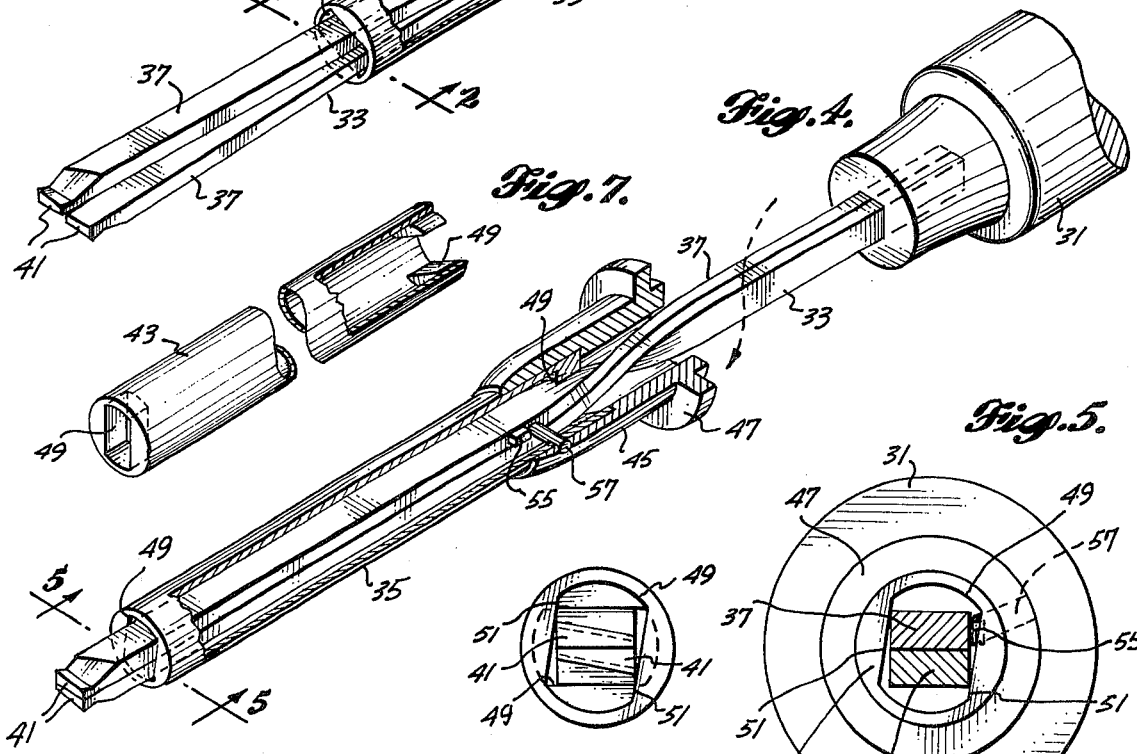
Fig. 4.
Fig. 7.
Fig. 6.
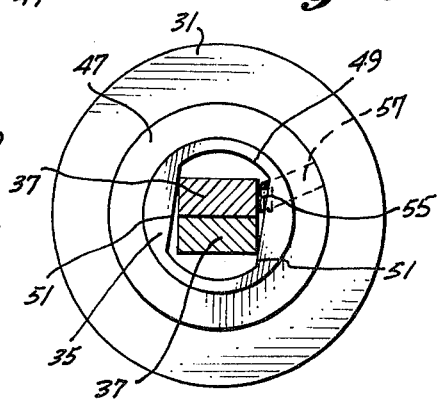
Fig. 5.
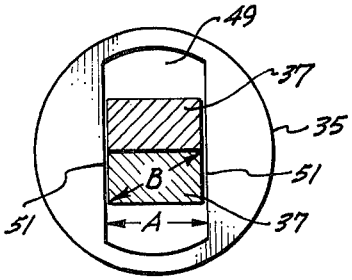
Fig. 10A.
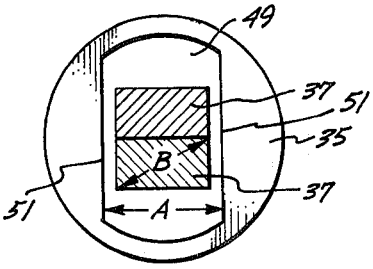
Fig. 10B.
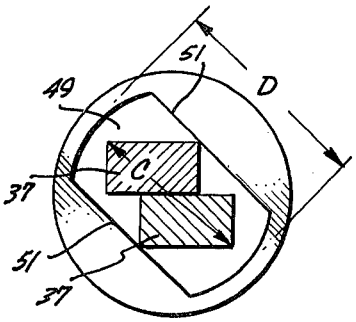
Fig. 10C.

Fig. 8.
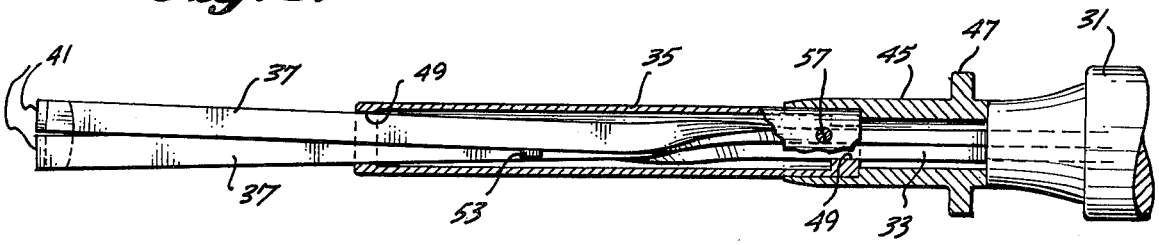
Fig. 9.
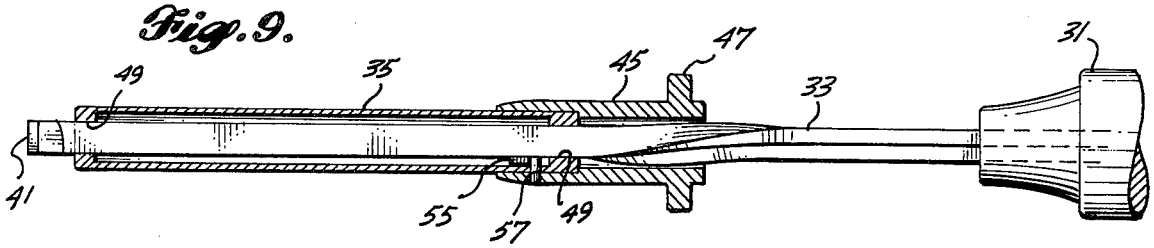
Fig. 12A.
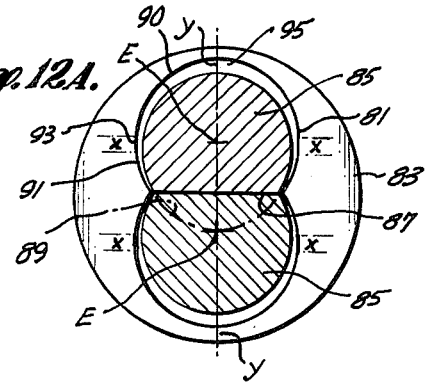
Fig. 12B.
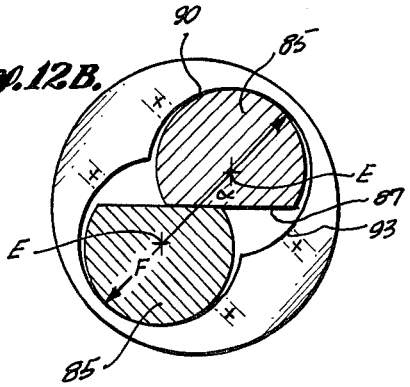
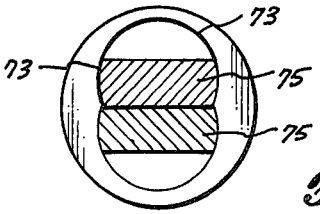
Fig. 11A.
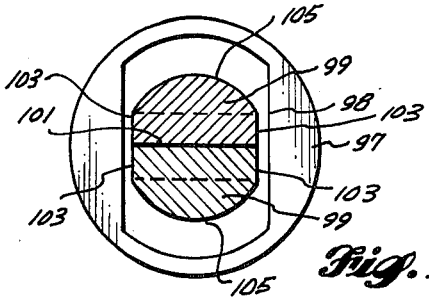
Fig. 13.
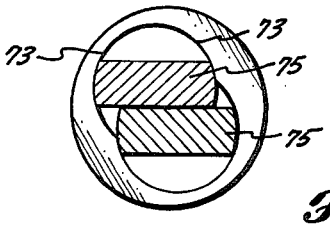
Fig. 11B.
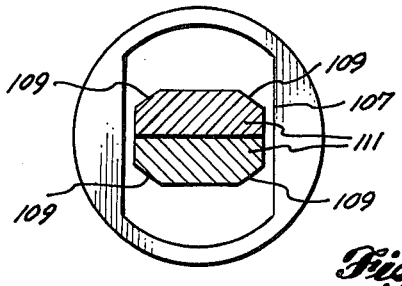
Fig. 14.

Fig. 15.
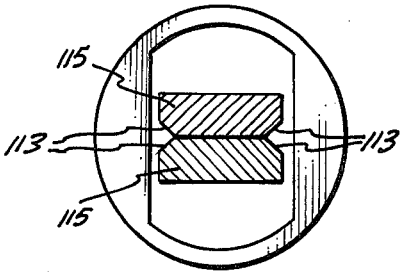
Fig. 16.
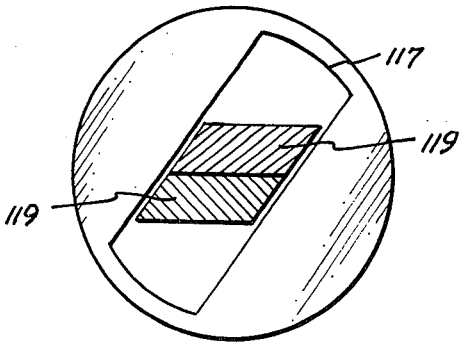
Fig. 17.
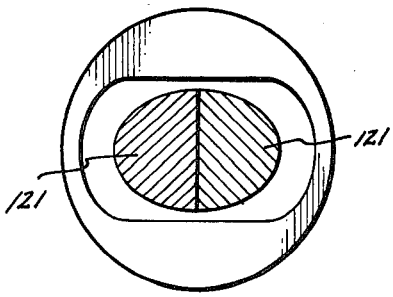
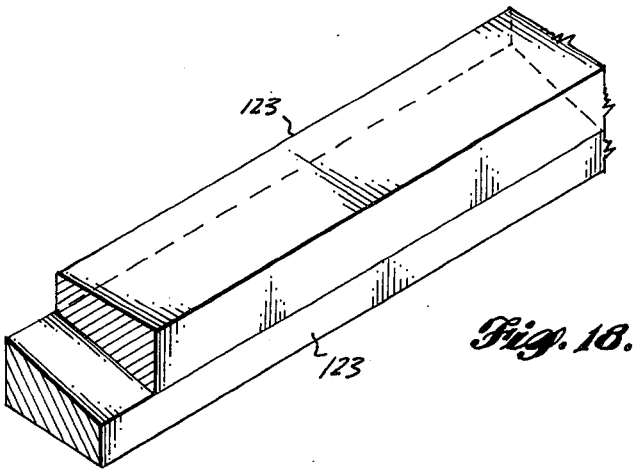
Fig. 18.
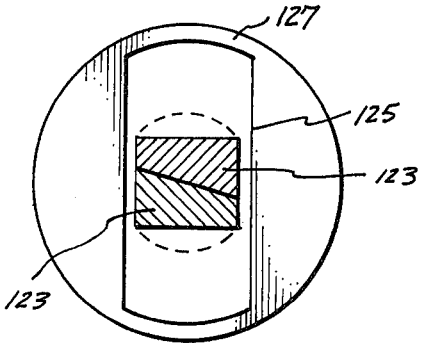
Fig. 19.
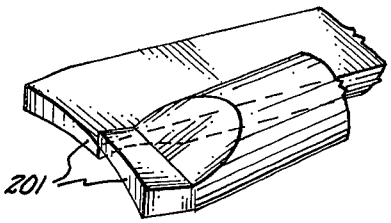
Fig. 20.
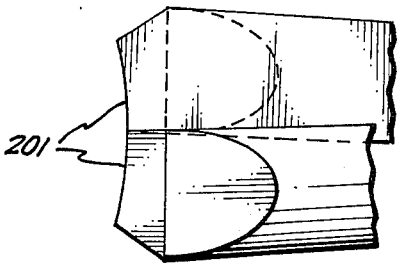
Fig. 21.

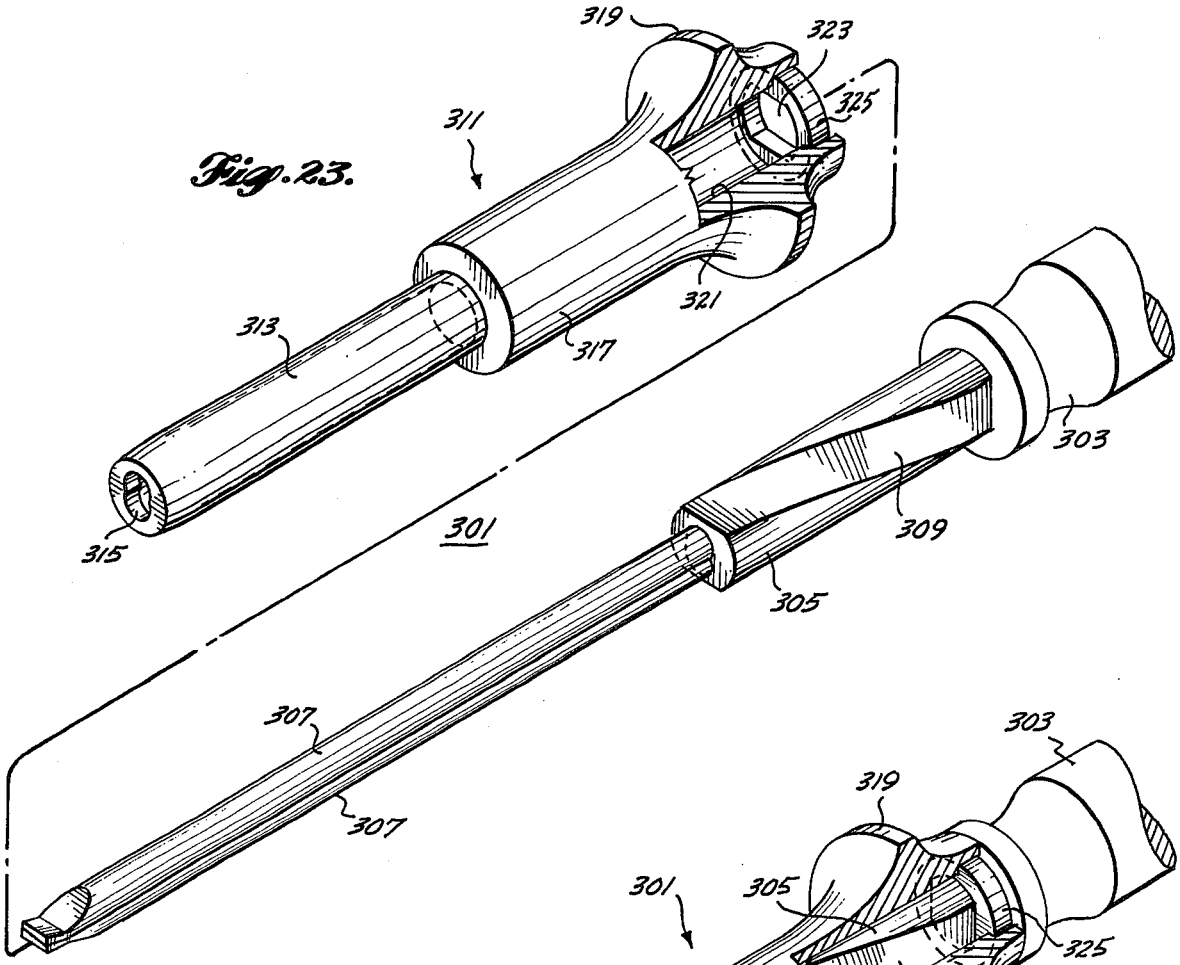
Fig. 23.
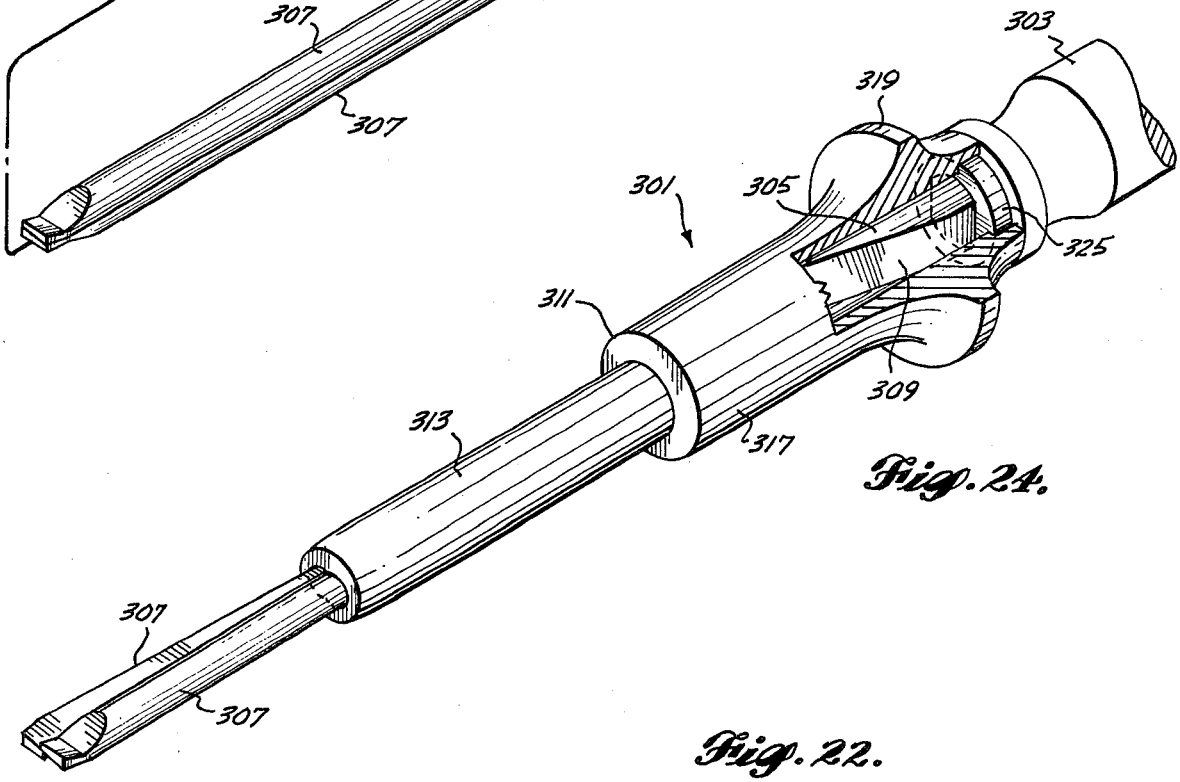
Fig. 24.
Fig. 22.
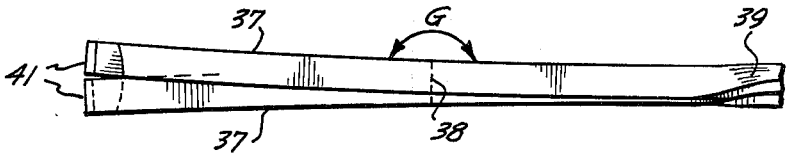

SLIDE MECHANISM FOR EXPANDABLE BIT SCREW HOLDING SCREWDRIVER

CROSS REFERENCE TO RELATED APPLICATIONS

This invention is related to an invention described in U.S. Pat. No. 3,900,057 filed Apr. 23, 1974 and entitled "EXPANDABLE BIT SCREW HOLDING SCREWDRIVER" by Earl Benitz. U.S. Pat. No. 3,900,057 discloses a particular blade configuration with which the present slide mechanism is useful. This application is also a continuation-in-part of U.S. patent application, Ser. No. 594,632 filed July 10, 1975, now abandoned, and entitled "SLIDE MECHANISM FOR EXPANDABLE BIT SCREW HOLDING SCREWDRIVER" by Earl Benitz, the inventor named in the present application. With respect to the common subject matter contained in the present application and United States patent application Ser. No. 594,632, the filing date of U.S. patent application Ser. No. 594,632 is claimed under 35 USC 120.

BACKGROUND OF THE INVENTION

This invention is directed to screwdrivers and more particularly to expandable bit screw holding screwdrivers.

Various types of expandable bit screw holding screwdrivers have been proposed by the prior art. In the past, these screwdrivers have had various disadvantages, many of which are overcome by the screwdriver described in U.S. Pat. No. 3,900,057. As noted above, U.S. Pat. No. 3,900,057 is primarily directed to a new and improved blade configuration. While this blade configuration has a variety of advantages over prior art blade configurations, the slide mechanism proposed for use in that screwdriver has certain disadvantages, particularly when the overall structure is embodied in a relatively large screwdriver. This invention is primarily directed to overcoming the disadvantages of that slide mechanism.

More specifically, the slide mechanism disclosed in U.S. Pat. No. 3,900,057 is similar to the slide mechanism disclosed in U.S. Pat. No. 3,224,479 and comprises a cylindrical member surrounding a split shank or shaft formed of two pieces that diverge outwardly, at least in the region of the blade. As the cylindrical member (slide) is moved from the screwdriver handle end of the shank toward the blade end, the diverging tips are forced toward one another causing the blade to expand in thickness. This slide mechanism has a number of disadvantages. First, as the diverging portions of the blade are forced toward one another, the portions of the split shank located inside of the slide tend to diverge, i.e., the two shank elements move away from one another, weakening the shank. In this regard attention is directed to FIG. 3 of U.S. Pat. No. 3,224,479. Second, the blade element maximum divergence is determined by the spring action of the split shanks, not by any external mechanical force. Third, the tight engagement of the blade in a screw slot may not be effectively released when a slide of this nature is withdrawn toward the handle because the slide does not create a releasing force. Rather, release force depends upon the spring force developed by the split shank.

While the present invention is primarily suited for use with an expandable bit screw holding screwdriver of the type described in U.S. Pat. No. 3,900,057, it readily will be recognized that it is also useful with other types of expandable bit screw holding screwdrivers, and other devices. p It is an object of this invention to provide a new and improved expandable bit screw holding screwdriver.

It is a further object of this invention to provide a slide mechanism suitable for use in controlling the expansion of a split shank such as that employed in an expandable bit screw holding screwdriver.

It is yet another object of this invention to provide a new and improved slide mechanism for an expandable bit screw holding screwdriver that creates a mechanical force that acts to expand and contract shank elements to thicken and thin the screwdriver blade formed by the tips of the shank elements, as desired.

Another disadvantage of prior art expandable bit screw holding screwdrivers relates to the configuration of the tip of the blade. Specifically, in most cases, as with conventional screwdrivers, the periphery of the tip of the blade of such a screwdriver lies orthogonal to the longitudinal axis of the shank. A "flat" blade tip periphery of this nature has certain disadvantages. For example, if a screw slot is occluded, the blade will not readily grip the sides of the screw slot. This invention is also directed to overcoming this disadvantage.

Therefore, it is a still further object of this invention to provide a new and improved blade tip configuration for an expandable bit screw holding screwdriver.

It is yet another object of this invention to provide a new and improved expandable bit screw holding screwdriver having a blade tip configuration adapted to more readily engage screw slots, particularly those wherein a portion of the slot is occluded.

SUMMARY OF THE INVENTION

In accordance with principles of this invention, a slide mechanism for an expandable bit screw holding screwdriver is provided. The slide mechanism comprises a shank or shaft, having a helical peripheral path, and a slide. Affixed at one end of the shank is a handle. A screwdriver blade, formed in the tips of two diverging shank elements, is located at the other end of the shank. The slide is coaxially mounted about the shank for longitudinal movement, and includes two spaced, shaped apertures. Coaction between one aperture and the outer surface of the diverging shank elements as the other aperture follows the helical path causes the slide to rotate and move the shank elements between divergent and aligned positions. More specifically, movement of the slide along the shank from the handle end toward the blade end causes the two shank elements to converge, thereby causing the blade to thicken. Reverse movement causes the opposite effect. Preferably, the shaped apertures each have long and short axes that are angularly displaced with respect to one another about the longitudinal axis of the slide.

In accordance with alternative principles of this invention, the shank or shaft may take on different forms. In one form, the entire shank or shaft consists of two facing pieces twisted through a predetermined arc at some point along the longitudinal length of the shank or shaft. Thus, the two diverging shank elements forming the screwdriver blade form a portion of an overall two piece twisted split shank, with the twist forming the helical path. Preferably, the diverging shank elements start at the end of the twist remote from the handle end and extend outwardly to the blade end. In an alternate form, the shank includes a generally tubular guide member having a helical path formed in its outer surface. The diverging shank elements extend coaxially outwardly from one end of the guide member and, if desired, may pass entirely therethrough. The screwdriver handle is located on the side of the guide member remote from the side from which the diverging shank elements project. The handle may be located contiguous to the guide member or spaced therefrom. Regardless of the specific form of the shank, the aperture in the tubular slide nearest the handle is sized and shaped so as to follow the helical path when the slide is moved toward the blade end of the screwdriver. The other aperture is sized and shaped so as to coact with the diverging blade elements such that, when the slide is moved toward the blade end and rotates as the slide aperture nearest the handle follows the helical path, the aperture coacting with the diverging blade elements causes these elements to converge and the blade to thicken. When the slide is located near the handle, the spaced apertures are generally located on opposite ends of the helical path.

Preferably, the shank element diverging direction is opposite to the helical path direction. That is, if the helical path forms a right handed helix, divergence is toward the left and vice versa if the helical path forms a left handed helix. In the embodiments of the invention wherein the helical path is formed by a pair of twisted shank elements, this divergence prevents separation in the twist region. More specifically, this arrangement results in a structure wherein the shank elements remain in contact in the region of twist when the slide is moved toward the blade end. Even more preferably, in addition to diverging outwardly in the direction opposite to the direction of twist, the shank elements are bent further outwardly in the same direction as the divergence direction at some point between the twist and the blade end. It has been found that this "additional" bend results in a structure wherein the blade does not loosen, after it has been inserted into a screw slot, as the slide is moved toward the blade end.

In accordance with yet other principles of this invention, the helical arc is approximately 90° and the perpendicular long and short axes angular displacement of the spaced apertures is approximately 90°.

In accordance with still other principles of this invention, the slide mechanism includes a stop that prevents the slide from sliding off of the blade end of the twisted shank.

In accordance with yet further principles of this invention, the cross-sectional shape of both the shank and the guide member (if one exists), and the slide apertures can take on a variety of forms. In one form, the shank is square in cross-section and the apertures include spaced flat regions separated by a distance slightly greater than the length of one side (but less than the diagonal distance) of the square shank. In an alternate form, the shank is curved on opposing, nonjoining surfaces, and one or both of the apertures define a figure eight silhouette. Still further, the cross sectional configuration of all or part of the shank may also define a figure eight silhouette. Other forms, too numerous to mention here, also fall within the scope of the invention.

In accordance with yet other principles of this invention, the peripheral tip of the blade of the expandable bit screwdriver diverges inwardly either in a shallow circular arc or in a shallow V, as desired. The inwardly divergence of the blade tip periphery results in the creation of "points" on either corner of the blade. The extending points allow the overall blade to more readily fit into screw slots, particularly those that are occluded in their center.

It will be appreciated from the foregoing description that the invention provides a new and improved slide mechanism for expandable bit screw holding screwdrivers. Preferably, the slide mechanism of the invention is used with a blade of the type described in U.S. Pat. No. 3,900,057; however, as noted above, the slide mechanism can be used with other blade configurations and with other devices. The slide mechanism of the invention is uncomplicated, yet it creates a blade positioning force in both its blade thickening and its blade thinning directions of movement. Thus, rather than relying upon spring force to release the blade when the slide is moved toward the handle, a mechanical release force is relied on. Further, because in the twisted shank element embodiments the shank elements diverge outwardly in a direction opposite to the direction of twist, shank element separation in the region of twist does not occur when the slide is moved toward the blade end so as to tighten the blade in a screw slot. Thus, shank strength is improved over prior art devices wherein the mid section of a split shank separates when the slide is moved to its blade thick position to tighten the blade in a screw slot. Hence, the invention overcomes many of the disadvantages of prior art slide mechanisms, particularly those of the type described in U.S. Pat. No. 3,224,479.

It has been found that embodiments of the invention wherein shank elements extend linearly outwardly from a helical path guide member result in a structure wherein the blade remains snug in a screw slot when the slide is moved toward the blade end. On the other hand, it has been found that, in some cases, embodiments of the invention wherein twisted and shank elements form the helical path result in a structure wherein a slight loosening of the blade occurs when the slide is so moved. Apparently, movement of the slide tends to withdraw the blade slightly from the screw slot. This potential disadvantage is overcome by the invention by bending the shank elements slightly between the twist and the blade tip, as noted above.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 1 is an isometric view, partially in section, of a twisted shank element side mechanism formed in accordance with the invention illustrating a screwdriver blade in a "thin" state;

FIG. 2 is a cross-sectional diagram along line 2—2 of FIG. 1;

FIG. 3 is a blade end view of FIG. 1;

FIG. 4 is an isometric view, partially in section, of a twisted shank element slide mechanism formed in accordance with the invention illustrating the screwdriver blade in a "thick" state;

FIG. 5 is a cross-sectional diagram along line 5—5 of FIG. 4;

FIG. 6 is an end view of FIG. 4;

FIG. 7 is an isometric view, partially in section, illustrating one form of a slide forming a part of the slide mechanism of the invention;

FIG. 8 is a sectional plan view of the structure illustrated in FIG. 1;

FIG. 9 is a sectional plan view of the structure illustrated in FIG. 4;

FIGS. 10A–10C are cross-sectional views of a slide aperture and a pair of shank elements, illustrating operative and nonoperative embodiments of the structure illustrated in FIGS. 1–9;

FIGS. 11A and 11B are cross-sectional views of an alternate embodiment of shank elements formed in accordance with the invention;

FIGS. 12A and 12B are cross-sectional view of a further alternate embodiment of shank elements formed in a accordance with the invention;

FIG. 13 is a cross-sectional view of another embodiment of shank elements formed in accordance with the invention;

FIG. 14 is a cross-sectional view of yet another alternate embodiment of shank elements formed in accordance with the invention;

FIG. 15 is a cross-sectional view of a still further alternate embodiment of shank elements formed in accordance with the invention;

FIG. 16 is a cross-sectional view of still yet another alternate embodiment of shank elements formed in accordance with the invention;

FIG. 17 is a cross-sectional view of a yet further alternate embodiment of shank elements formed in accordance with the invention;

FIG. 18 is a partial isometric view of a different shank element mating surface formed in accordance with the invention;

FIG. 19 is a cross-sectional view illustrating the shank elements illustrated in FIG. 18 mounted in a slide aperture;

FIG. 20 is a partial isometric view illustrating a blade tip formed in accordance with the invention;

FIG. 21 is a plan view of the blade tip illustrated in FIG. 20;

FIG. 22 is a pictorial view of a pair of twisted shank elements bent slightly in their diverging direction between the region of twist and the blade end of the shank elements;

FIG. 23 is an exploded isometric view, partially in section, of an embodiment of the invention wherein the shank includes a helical path guide member and a pair of diverging shank elements extending co-axially outwardly therefrom; and FIG. 24 is an assembled isometric view, partially in section, of the embodiment of the invention illustrated in FIG. 23 wherein the slide is mounted on the shank and positioned adjacent to the handle of the overall expandable bit screw holding screwdriver.

DESCRIPTION OF THE PREFERRED EMBODIMENTS

Prior to describing the preferred embodiments of the invention, certain of the terminology used is discussed. For purposes of discussion, the unexpanded, or shank element diverged, state of the expandable bit screw holding screwdiver is referred to as the "thin" state of the screwdriver blade, i.e., the state that the screwdriver blade is in when it is being inserted into or removed from the slot of a screw, or when the slide of the slide mechanism is located nearest to the handle end of the screwdriver. Contrawise, the expanded, or shank element converged, state is referred to as the "thick" state of the screwdriver blade, i.e., the state that the screwdriver blade is in when it has been expanded to fill the slot of a screw between the sidewalls thereof, or when the slide is located nearest to the blade end.

Also, for purposes of discussion, in order to distinguish between the two basic structures, they are hereinafter identified slightly differently. Structures wherein the helical path is formed in the shank elements are referred to as the twisted, split shank embodiments of the invention; and, structures wherein the helical path is formed in a guide element are referred to as guide element embodiments of the invention. As will be better understood from the following discussion, the twisted, split shank embodiments are generally illustrated in FIGS. 1–9 and 22 and the guide element embodiments are generally illustrated in FIGS. 23 and 24. The remaining figures, while generally discussed with respect to the twisted, split shank embodiments, actually pertain to both embodiments since these figures are directed to the shape of the apertures and the cross-sectional configuration of the shank elements.

Turning now to the drawings, FIGS. 1–9 illustrate a twisted, split shank embodiment of the invention. FIG. 1 illustrates the embodiment in its thin state and FIG. 4 illustrates the same embodiment in its thick state. The expandable bit screwdriver illustrated in FIGS. 1–9 generally comprises: a handle 31; a twisted, split shank 33; and, a slide 35. The twisted, split shank 33 and the slide 35 combine to form the slide mechanism of the invention.

The twisted, split shank 33 comprises first and second shank elements 37 having handle and blade ends. Each shank element is identically formed of an elongated piece of steel (preferably spring steel) having a rectangular cross section along the major portion of its length. While various dimensions can be utilized, in one form, the cross-sectional dimension is $\frac{1}{8}$ inch thick by $\frac{1}{4}$ inch wide. Each shank element 37 is twisted at approximately its center and the elements are mounted in a face-to-face manner, whereby, when appropriately aligned, they form a square cross-sectional shape. Thus, the composite twisted, split shank 33 includes a twisted region 39. The twisted region forms or defines a helical path, hereinafter more fully described. While the twisted region 39 is illustrated at the center of the shank, it could be located nearer to the handle end or nearer to the blade end, depending upon the length of the shank. For a "short" shank nearer to the handle is preferred while for a long shank, any reasonable position is satisfactory.

The handle ends of the shank elements 37 are affixed to an end of the handle 31. The blade ends of the shank elements combine to form a screwdriver blade. The screwdriver blade, thus, comprises two blade tips 41, one formed in the end of each shank element 37. Preferably, the blade tips 41 are formed in the manner described in the U.S. Pat. No. 3,900,057 referenced above, even through they may be formed in other manners.

The portion of the shank elements 37 located on the side of the twisted region 39 remote form the handle 31 diverge outwardly. The direction of divergence is such that these elements maintain face-to-face contact, but over a lesser common area, moving from the twisted region 39 to the blade tips 41. In other words, the elements 37 do not become spaced from one another, rather they diverge in the plane defined by their common interface. Preferably, the direction of diverence is opposite to the direction of twist. For example, in FIGS. 1, 2, 8 and 9, viewing the shank 33 from the handle 31, the twist direction is toward the left, and the divergence direction of the "upper" shank element, beyond the twist, is toward the right. If the twist direction were toward the right, the divergence direction of the "upper" shank element would be, preferably, toward the left. The divergence/twist relationship prevents a gap from opening between the shank elements 37 in the twisted region 39 when the screwdriver blade is moved from its "thin" state to its "thick" state.

While various angles of twist can be used, preferably, the twist angle is 90°, or slightly greater. In addition, while various divergence angles can be used, preferably, the amount of divergence is such that the blade tips 41 just overlap or are slightly spaced from one another when the slide 35 is adjacent to the handle 31.

It has been found that, while the just described shank elements illustrated in FIGS. 1–9 operate satisfactorily in most cases, when the slide 35 is moved from the handle toward the blade tip end of the shank, as herein described, in some cases an undesirable slight loosening of the bite of the blade end in a screw slot may occur. The invention overcomes this potentially undesirable loosening that may occur with twisted, split shank embodiments in the manner illustrated in FIG. 22. More specifically, as illustrated in FIG. 22, rather than the shank elements 37 diverging linearly outwardly from the twist region 39, a slight outward bend in the direction of divergences occurs at some point between the twist region and the tips 41. It has been found that this slight divergence (illustrated by bend angle G of slightly less than 180°), results in a structure wherein movement of the slide toward the blade tip end of the shank elements, when the blade is located in a screw slot, does not result in a slight loosening of the tips 41 in the slot.

While the slide 35 could be formed of a single tubular piece, the illustrated slide is formed of two pieces—a tubular control element 43 and a tubular operator element 45. Both the control element 43 and the operator element 45 surround the twisted, split shank 33. The operator element 45 is located nearest the handle 31 and includes an outwardly projecting cylindrical flange 47. The control element 43 is affixed to (for example, by a pin or cap screw 57), and extends axially outwardly from, the other end of the operator element 45.

As best illustrated in FIG. 7, the control element 43 includes a shaped aperture 49 located at either end. The shaped apertures 49 are connected by a larger (in diameter) center aperture. The shaped apertures are similarly shaped and have perpendicular long and short axes. The perpendicular long and short axes of the shaped apertures are angularly displaced, with respect to one another, about the longitudinal axis of the slide 35 by a predetermined amount, preferably 90°. The apertures 49, as best seen in FIGS. 2, 3, 5 and 6, have the shape of two opposing flat surfaces or flats 51 connected by two opposing semicircular regions 53. The preferred spacing between the flats 51 is hereinafter discussed with respect to FIGS. 10A–10C.

The tubular control element 43 is formed such that the apertures 49 lie on either side of the twisted region 39, when the screwdriver is in the nonexpanded (e.g. thin) state. The front aperture 49, i.e., the one nearest the tips 41, acts as a compression aperture such that when the slide 35 is moved, toward the blade end, and rotated, this aperture causes the diverging portions of the shank elements 37 to converge and thicken the screwdriver blade. The rear aperture 49 follows the twisted region of the shank, which defines a helical path, and causes the slide 35 to rotate as it is moved.

A stop mechanism prevents the slide from sliding off of the twisted, split shank 33. The stop mechanism comprises a stop projection 55 affixed to one edge of one of the shank elements 37, and a pin 57. The pin 57 projects inwardly through both the operator element 45 and the control element 43 such that it impinges on the stop projection when the slide is moved to a predetermined point near the blade end. Alternatively, a stop may be automatically built in, in embodiments wherein the shanks are bent in a direction opposite to the direction of rotation, by angularly displacing the apertures by an appropriate amount. Also, a stop may be built in by extending the twist region (e.g. helical path) slightly.

In operation, when the slide 35 is located nearest the handle 31, the blade tips 41 are in their thinnest state, as illustrated in FIG. 1. As the slide 35 is moved toward the blade elements, it is caused to rotate by the rear aperture following the twist (helical path) in the twisted, split shank 33. As the slide rotates, the front aperture 49 causes the diverging portions of the twisted, split shank 33 to converge until, at the stop position, the shank elements are aligned with one another, as illustrated in FIG. 4. This is the maximum thickened state of the blade tips 41. In most instances, the shank elements 37 will not achieve this maximum state before the outer surfaces of the tips 41 come into gripping contact with the sides of a screw slot. Upon reversal of the slide, i.e., return slide movement toward the handle 31, reverse rotation of the slide creates a positive mechanical force on the shank elements. This force forces the blade tips toward their thin state. Because a mechanical force is created, the invention does not depend solely upon spring force to thin the blade tips, whereby screw slot disengagement problems are essentially eliminated.

It will be appreciated that, in order to prevent binding, the distance between the flats 51 of the front aperture 49 of the slide 35 must be somewhat greater than the width of the shank 33. On the other hand, this distance must also be less than some maximum value for the desired action to occur. Similarly, the distance between the semicircular regions must be above some minimal value. FIGS. 10A–10C illustrate generally the necessary dimensional relationships. In FIGS. 10A and 10B, the letter A represents the distance between the flats; and, the letter B represents the diagonal cross-sectional distance of one shank element 37. FIG. 10A depicts the situation where dimension A is less than dimension B. This dimensional relationship will not result in the creation of an operative structure because the shank elements 37 will bind on the flats 51. FIG. 10B illustrates a structure wherein dimension A is equal to or greater than dimension B. This dimensional relationship will result in the creation of a structure that will operate satisfactorily without binding.

In FIG. 10C, the letter C represents the maximum diagonal distance between both shank elements 37 needed for a particular structural embodiment of the invention to operate satisfactorily; and, letter D represents the distance between the semicircular regions 53, i.e., the diameter defined by the curved regions of the aperture 49. As long as dimension C is less than dimension D, the resultant structure will operate satisfactorily.

FIGS. 1–9 illustrate one preferred embodiment of the twisted, split shank embodiments of the invention. In addition, there are a number of other preferred embodiments of the twisted, split shank embodiment. The primary differences between these additional embodiments and the FIGS. 1–9 embodiment are the cross-sectional shapes of the shank elements 37 and the shaped apertures 49. Only these differences are discussed below, it to be understood that the other aspects of the invention remain substantially the same, i.e., the related shank elements are twisted through a predetermined angle, preferably approximately 90°, and the perpendicular long and short axes of the apertures are angularly displaced with respect to one another through a predetermined angle, also preferably approximately 90°. Further, the shank elements diverge beyond the twisted region, and a stop mechanism is included. And, if necessary, the shank elements are bent outwardly (e.g. in the direction of divergence) by a slight amount at some point betwen the twisted region and the blade tips.

FIGS. 11A and 11B illustrate an arrangement wherein the aperture flats 73 converge inwardly, until they reach a point. Thus, the apertures have a figure eight cross-sectional shape. In this embodiment, the surfaces of the edges of the shank elements 75 that impinge on the aperture flats are curved. The radius of curvature of the edges of the shank elements is generally equal to the radius of curvature of the "curved" flats, less an amount necessary to allow for freedom of movement. Thus, preferably there is no separation between the shank elements 75 and the aperture flats 73 in the region where they meet, even though a separation distance could be provided, if desired. In operation, the curved sides of the shank elements slide on the curved flats between the "thick" blade position illustrated in FIG. 11A and the "thin" blade position illustrated in FIG. 11B.

One of the advantages of the structure illustrated in FIGS. 11A and 11B is the increased wearing area (the region of impingement between the shank elements 75 and the "flats" of the aperture 73). As will readily be appreciated, this wearing area is substantially greater than the wearing area of the embodiment illustrated in FIGS. 1–9. FIGS. 12A and 12B illustrate a shank element/aperture arrangement wherein this wearing area is further increased.

In FIGS. 12A and 12B, both the shaped apertures 81 formed in the ends of a slide element 83 and the shank elements 85, when aligned, define a figure eight. More specifically, each of the shank elements 85, has a circular cross-sectional shape, terminating at a flat side. The circular cross-section covers an arc substantially greater than 180°, but less than 360°. The flat sides meet along a flat junction 87. The shape is such that if the radius of curvature of the semicircular sides were extended, as illustrated by the dotted line 89 for the upper element 85, each would pass through the center of curvature, E, of the other element.

The upper and lower portions of the figure eight apertures 81 include outer sections 90 having a radius of curvature equal to the radius of curvature of the semicircular sides of the shank elements 85. The outer sections 90 are joined to inner sections 91 having a similar radius of curvature by short, flat sections 93.

When the shank elements 85 are aligned in a figure eight manner in the aperture 81, as illustrated in FIG. 12A, a distance, Y, equal to the length, X, of the short, flat sections 93 separates the aligned shank elements 85 from the outer tips 85 of the outer sections 90 of the aperture 81. This is the "thick" blade position. When the shank elements are in the "thin" blade position, as illustrated in FIG. 12B, they are, as with the other embodiments of the invention, offset with respect to one another. In this position, the overall distance between the outer sections 90, defined by distance F, determines the amount of allowable blade divergence. In this regard, distance F is equal to the distance through the centers E of the shank elements 85 when these elements are in the position of minimum blade thickness. In other words, distance F is equal to twice the distance Y, plus twice the diameter of the radius of curvature of the shaft elements 85, minus the portions removed in the regions of the adjoining surface 87 at the angle, $\alpha$, of minimum blade thickness.

FIG. 13 illustrates a further alternate structure that is essentially a combination of the structures illustrated in FIGS. 1–9 and the structure illustrated in FIGS. 12A and 12B. More specifically, the slide 97 illustrated in FIG. 13 has a shaped aperture configuration 98 similar to the aperture configuration illustrated in FIGS. 1–9. The shaft elements 99 are flat where they join 101, and they have flat sides 103. However, the surfaces 105, opposed to the joining flat sides, are curved rather than flat.

FIG. 14 illustrates a further embodiment of the invention also somewhat similar to the structure illustrated in FIGS. 1–9. Again, the aperture 107 is the same. The difference is that all of the outer corners 109 of the shaft elements 111 have been removed to reduce the distance D constraint, illustrated in FIG. 10C. Similarly, FIG. 15 illustrates a still further arrangement wherein adjacent corners 113 of each of the shaft elements 115 have been removed.

FIG. 16 is a cross-sectional view of an arrangement wherein the shaped aperture 117 is similar to the aperture illustrated in FIGS. 1–9, but a cross-sectional view of the shaft elements 119 defines a non-rectangular parallelogram, rather than a rectangular or square parallelogram. Obviously, the FIG. 16 embodiment works best in only one direction of rotation, since the other direction results in binding of the shank element sides on the "flats" of the aperture.

FIG. 17 illustrates a shaped aperture/shank element arrangement wherein the cross-sectional configuration of the combined twisted shaft elements 121 define an oval.

FIG. 18 is a perspective view of a portion of a pair of shaft elements 123. While the overall cross-sectional configuration of the shaft elements 123 defines a square or rectangle, the interface therebetween lies along a transverse, longitudinal plane passing obliquely through the shaft, including opposing edges thereof. FIG. 19 illustrates the shaft elements shown in FIG. 18 mounted in an aperture 125 formed in a slide 127. FIG. 19 also illustrates (by dotted lines) that, if desired, the outer opposing surfaces of the twisted shaft elements could be curved rather than flat.

The foregoing descriptions have generally described twisted, split shank embodiments of the invention. That is, these descriptions have been directed to embodiments of the invention wherein a pair of shank elements, extending from a handle of the overall screwdriver to the screwdriver blade, are twisted such that the twist defines a helical path. The twisted, split shank co-acts with an apertured slide. One slide aperture acts to compress or converge the shank elements as the other aperture follows the helical path formed by the twist in the shank. In contrast to this arrangement, FIGS. 23 and 24 illustrate helical guide element embodiments of the invention wherein the helical path is formed in a guide element rather than in the shank elements. The guide element is located between linearly diverging shank elements and the handle of the screwdriver. The shank elements may be coaxially affixed to one end of the guide element or they may be surrounded, at one end, by the guide element, and extend into the handle. In either case, when the blade tips are in their "thin" state, the slide is nearest to the handle and the shank elements diverge outwardly in a mating plane from the guide element to the blade end of the overall structure. As the slide is moved toward the blade tips, an aperture formed in the end of the slide nearest the tips causes the shank elements to converge and the tips to achieve their blade thick state. This convergence action occurs as an aperture formed in the end of the slide nearest the handle follows the helical path formed in the outer surface of the guide element.

More specifically, FIGS. 23 and 24 illustrate an expandable bit screw holding screwdriver 301. The screwdriver includes a handle 303. Extending coaxially outwardly from one end of the handle 303 is a generally tubular guide element 305. The guide element includes a helical path or track 309 in its outer surface. The helical path extends through an arc of approximately 90° and performs the same function as the twist in the shank elements of the previously described emodiments of the invention. For purposes of illustration, when viewed from the handle, the helical path 309 is depicted as a right-handed to provide contrast to the left-hand path illustrated in FIGS. 3, 4, 8 and 9, of the twisted, split shank embodiments of the invention illustrated and described above.

Extending coaxially outwardly from the helical guide element 305 are a pair of shank elements 307. The shank elements 307 are linear and meet in a facing plane. When in the blade thin state, the shank elements 307 diverge outwardly in their facing or mating plane as best illustrated in FIG. 24. The cross-sectional configuration of the shank elements 307 is generally similar to the cross-sectional configuration of the shank elements illustrated in FIGS. 12A and 12B, discussed above.

Coaxially mounted about the helical guide element 305 and the shank elements 307 is a slide 311. The slide 311 includes a shank control segment 313 coaxially mounted about the shank elements 307. Formed in the outer end, i.e., the end nearest the blade of the screwdriver structure is a first shaped aperture 315. The first shaped aperture is in the form of a figure eight and, preferably, is similar to the figure eight aperture illustrated in FIGS. 12A and 12B, and described above. The inner wall of the shank control segment 313 projecting inwardly (i.e., toward the handle 303) from the first shaped aperture is cylindrical and substantially larger in diameter than the maximum cross-sectional dimension of the first shaped aperture 315.

The end of the shank control segment 313 remote from the end containing the first shaped aperture 315 is coaxially fixed to one end of a guide follower segment 317. The guide follower segment 317 is generally cylindrical and includes a ring shaped, outwardly projecting flange 319 adapted to allow a user's fingers to easily slide the slide 311 back and forth along the longitudinal length of the shank between the handle and the blade.

The guide follower segment 317 includes a cylindrical coaxial inner aperture 321 having a diameter larger than the diameter of the generally tubular guide element 305. Located in the end of the inner aperture of the guide follower segment 317 nearest the handle 303 is a second shaped aperture 323. The second shaped aperture 323 may be formed in the related end of the inner aperture 321, or it may be formed in another element, such as a flat washer 325, that is pressed into the appropriate end of the inner aperture 321. The second shaped aperture 323, regardless of how specifically formed, has a configuration similar to the cross-sectional peripheral configuration of the guide element 305, i.e., it includes two curved sides joined by two flat sides. Not only is the configuration the same, the size of the second shaped aperture 323 is the same size as the size of the external periphery of a cross-section of the guide element 305.

In operation, the slide 311 is coaxially mounted on the shank such that the first shaped aperture 315 lies about the shank elements 307 and the second shaped aperture 323 lies about the outer surface of the guide element 305. As the thusly mounted slide 311 is longitudinally moved back and forth along the shank between the blade and the handle of the screwdriver, it functions in a manner identical to the functional operation of the slides of the twisted, split shank embodiments of the invention. That is, the slide rotates as it is longitudinally moved, due to the second shaped aperture 323 following the helical path formed in the outer periphery of the guide element 305. This rotation causes the first shaped aperture to move the shank elements 307 between the blade thick and blade thin states. More specifically, movement of the slide toward the blade causes the blade tips to move from their blade thin state to their blade thick state and movement of the slide form the blade toward the handle causes the blade tips to move from their blade thick state to their blade thin state.

It has been found that a structure of the type illustrated in FIGS. 23 and 24, does not create a slight loosening of the blade tips in a screwdriver slot when the slide is moved toward the blade, as sometimes occurs with twisted, split shank embodiments of the invention, as discussed above. Thus, a slight bend of the type illustrated in FIG. 22 and previously described, is not necessary.

As with the shaped apertures of the twisted, split shank embodiments of the invention, both the first and second shaped apertures illustrated in FIGS. 23 and 24 have perpendicular long and short axes that are angularly displaced by 90°. While this arrangement is preferable, since the helical path is in a separate independent element, (e.g., the guide element) that can be oriented about the longitudinal axis of the screwdriver in a variety of manners with respect to the linear shank elements, this arrangement is not entirely absolutely necessary. For example, rather than the curved outer regions of the shank elements 307 being aligned with the "ends" of the spiral path 309, as illustrated in FIG. 23, they could be angularly displaced by 90° (or any other angle for that matter). In such an arrangement, the angular orientation of the first and second shaped apertures, of course, must be positioned in a compensating angular orientation. Moreover, while the shaped apertures of twisted, split shank embodiments of the invention are preferably the same in size and shape, the shaped apertures of helical guide element embodiments need not necessarily be the same in either size or shape. As noted above, the first shaped aperture 315, in the embodiment illustrated in FIGS. 23 and 24, is shaped the same as the shaped apertures illustrated in FIGS. 12A and 12B. In contrast, the second shaped aperture, i.e., the one surrounding the guide element 305 is in the form of the shaped apertures illustrated in FIGS. 5 and 6 and previously described. On the other hand, these shaped apertures could have the same silhouette if desired. Moreover while the second shaped aperture 323 is illustrated as larger in overall cross-sectional size than the first shaped aperture 315 because the cross-section size of the spiral guide element 305 is larger than the cross-sectional size of the shank elements, the apertures could be similarly sized. In such an arrangement, of course, the cross-sectional size of the guide element and the shank elements would have to be similar.

It is pointed out here that while the guide element 305 illustrated in FIGS. 23 and 24 starts at the handle 303, and terminates where the shank elements 307 project outwardly, the guide element could be displaced from the handle if desired. That is, one end of the guide element does not necessarily need to be contiguous to the handle; rather, the guide element could be displaced toward the blade, away from the handle. Also, while a pair of opposing helical paths 309 are shown as formed in the periphery of the guide element 305, a single path could be used in combination with a single following "flat" formed in the second aperture 323, if desired. Hence, as with the twisted, split shank embodiments of the invention, a variety of changes can be made to the illustrated and described helical guide element embodiment. In this regard, it should be recognized that the various cross-sectional configurations of the shank elements illustrated and described above with respect to the twisted, split shank embodiments can also be used in helical guide element embodiments of the invention.

In addition to the slide mechanism, the invention also provides an improved blade structure. Specifically, the invention provides a blade structure wherein the outer tip of the blade diverges inwardly. The divergence may take the form of a concave curve 201, as illustrated in FIGS. 20 and 21 or a shallow V (not shown). The inwardly diverging blade tip allows the blade to be more readily inserted into a screw slot, particularly one that is partially occluded. In this regard, if the screw slot is partially occluded, particularly in the center, the outer tips of the blade move further into the screw slot than would be the case if the blade tip did not diverge inwardly, prior to the expansion of the blade against the sides of screw slot. Thus, a better, and more reliable, grip of the screw slot results.

It will be appreciated from the foregoing description that the invention provides both a new and improved slide mechanism suitable for use in an expandable bit screw holding screwdriver and an improved blade structure. The slide mechanism provides a positive action both while moving the shaft elements to the expanded position during screw slot insertion and while withdrawing the shaft elements during extraction. The mechanism is uncomplicated yet provides a positive action. In addition, because the divergence of the shaft elements is opposite to the helical path direction in the twisted shank embodiments, the shank elements in the twist region do not become separated when these elements are in the blade thick position, whereby the strength of the overall structure is greater than it would be if the reverse were true, i.e., if separation were allowed to occur.

While preferred embodiments of the invention have been illustrated and described, it will be appreciated by those skilled in the art and others that various changes can be made therein without departing from the spirit and scope of the invention. For example, cross-sectional configurations other than those specifically illustrated can be formed, if desired. Thus, the invention can be practiced otherwise than as specifically described herein.

The embodiments of the invention in which an exclusive property or privilege is claimed are defined as follows:

1. In an expandable bit screwholding screwdriver wherein a pair of mating, elongated diverging shank elements are compressed together to move blade elements formed at one end of the shank elements from a blade thin state to a blade thick state and vice versa, the improvement comprising a slide mechanism for creating a positive mechanical force adapted to move the shank elements between said blade thin and blade thick states, said slide mechanism comprising:

a twist in said shank elements, intermediate the ends thereof, formed such that the shank formed by said shank elements becomes a twisted split shank; and, an elongated tubular slide mounted about said twisted split shank, said slide including a shaped aperture formed in both ends thereof, said shaped apertures each having perpendicular long and short axes, said apertures being positioned such that the long and short axes of the apertures are angularly displaced with respect to one another about the longitudinal axis of said tubular slide, said shaped apertures contacting the shank elements such that longitudinal movement of said slide causes said tubular slide to rotate about said shank elements and said positive mechanical force to occur.

2. The improvement claimed in claim 1 wherein said shaped apertures are located on both sides of the twist in said twisted split shank when said shank elements are in said blade thin state.

3. The improvement claimed in claim 2 wherein said slide is cylindrical, the region of said cylindrical slide located between said shaped apertures having a cross-sectional area greater than the cross-sectional area of said shaped apertures.

4. The improvement claimed in claim 3 wherein the cross-sectional configuration of each shank element of said twisted split shank includes a flat mating surface that mates with the other shank element along a plane that twists in the area of said twist in said shank elements.

5. The improvement claimed in claim 4 wherein said shaped apertures include a pair of parallel opposing flat surfaces.

6. The improvement claimed in claim 5 wherein said twisted split shank has an overall rectangular cross-sectional configuration.

7. The improvement claimed in claim 5 wherein at least a portion of the outer surfaces of the overall twisted split shank are curved.

8. The improvement claimed in claim 5 wherein said twisted split shank has a generally rectangular cross-sectional configuration, less the outer corners thereof.

9. The improvement claimed in claim 5 wherein said twisted split shank has a generally rectangular cross-sectional configuration, less adjacent corners of the shank elements.

10. The improvement claimed in claim 5 wherein said twisted split shank has a rectangular cross-sectional configuration and said mating surface lies along a transverse plane that is oblique to said generally rectangular cross-sectional configuration and passes through opposing edges thereof.

11. The improvement claimed in claim 5 wherein said twisted split shank has a non-rectangular parallelogram cross-sectional configuration.

12. The improvement claimed in claim 5 wherein said twisted split shank has an oval cross-sectional configuration.

13. The improvement claimed in claim 4 wherein the cross-sectional configuration of said shaped apertures is defined by a pair of adjacent, similarly formed, generally circular regions, each of said regions covering an arc of substantially more than 180°, but less than 360°, said regions joining at the terminal ends of their respective arcs.

14. The improvement claimed in claim 13 wherein said twisted split shank has a cross-sectional configuration defined by a pair of circular elements terminating in flat sides, each of said circular elements having a circular surface covering an arc of substantially greater than 180°, but less than 360°, said elements mating along their flat sides.

15. The improvement claimed in claim 4 wherein said twisted split shank has a generally rectangular cross-sectional configuration with opposing, non-mating surfaces of each shank element being curved.

16. The improvement claimed in claim 1 including a stop mechanism for preventing said slide from sliding off the blade element end of said twisted split shank.

17. The improvement claimed in claim 1 wherein the twist in said shank elements defines an arc of approximately 90° and wherein said long and short axes of said shaped apertures are displaced by approximately 90°.

18. The improvement claimed in claim 1 wherein said shank elements diverge in directions such that said shank elements remain in contact in the region of twist when said elongated tubular slide is moved toward said blade element end of said twisted split shank.

19. In an expandable bit screwholding screwdriver comprising an elongate shank including a pair of shank elements, having blade tips formed at one end, movable between a position whereat the shank elements diverge outwardly such that the blade tips lie in a blade thin state and a position whereat the shank elements are in alignment such that the blade tips lie in a blade thick state; and, a slide mounted on said elongate shank for longitudinal movement toward and away from said blade tips, movement toward said blade tips causing said shank elements to move from a divergent position toward an aligned position, the improvement comprising:

guide means formed in said elongate shank, said guide means including a helical path; and, elongate guide follower means formed in said slide, said guide follower means including first and second shaped apertures spaced along the longitudinal length of said slide, said first of said shaped apertures surrounding said shank elements between one end of said helical path and said blade tips and said second of said shaped apertures positioned adjacent to said helical path, said second shaped aperture formed such that longitudinal movement of said slide toward said blade tips causes said slide to rotate about said shank, as a result of coaction between said helical path and said second shaped aperture, said rotation being in one direction when said slide is moved toward said tips and in the opposite direction when said slide is moved away from said tips, said first shaped aperture formed such that it coacts with said shank elements to move said shank elements from said divergent position toward said aligned position when said slide rotates as it moves toward said blade tips and from said aligned position toward said divergent position when said slide rotates as it is moved away from said blade tips.

20. The improvement claimed in claim 19 wherein at least one of said shaped apertures has perpendicular long and short axes.

21. The improvement claimed in claim 19 wherein said guide means is formed by a twist in said pair of shank elements, said twist forming said helical path.

22. The improvement claimed in claim 19 wherein said guide means is formed by a separate elongate guide element having a helical path in its outer periphery, said shank elements extending coaxially longitudinally outwardly from one end of said elongate guide element.

23. The improvement claimed in claim 22 wherein said shank elements are linear.

24. The improvement claimed in claim 23 wherein said second shaped aperture has a cross-sectional configuration similar to the cross-sectional configuration of said elongate guide element, and wherein said first shaped aperture is defined by a pair of adjacent, similarly formed, generally circular regions, each of said circular regions covering an arc of substantially more than 180°, but less than 360°, said regions joining at the terminal ends of their respective arcs.

25. An expandable bit screw holding screwdriver comprising:

an elongate handle;

an elongate shank extending coaxially outwardly from one end of said elongate handle, said elongate shank including a pair of shank elements having blade tips formed at one end thereof, said shank elements being movable between a position whereat said shank elements diverge outwardly such that the blade tips lie in a blade thin position and a position whereat the shank elements are in alignment such that the blade tips lie in a blade thick position, said elongate shank further including a helical path formed in its outer periphery; and, a slide mounted on said elongate shank for longitudinal movement toward and away from said blade tips, said movement toward said blade tips causing said shank elements to move from said divergent position toward said aligned position and movement of said slide away from said blade tips causing said shank elements to move from said aligned position toward said divergent position, said slide including first and second shaped apertures spaced along the longitudinal length of said slide, said first shaped aperture surrounding said shank elements and said second shaped aperture adapted to follow said helical path as said slide is moved toward and away from said blade tips, said following action causing said slide to rotate in one direction or the other depending on the longitudinal direction of slide movement, said rotation causing said first aperture to move said shank elements between said aligned and divergent positions.

26. The expandable bit screw holding screwdriver claimed in claim 25 wherein at least one of said shaped apertures has perpendicular long and short axes.

27. The expandable bit screw holding screwdriver claimed in claim 25 wherein said helical path is formed by a twist in said pair of shank elements.

28. The expandable bit screw holding screwdriver claimed in claim 25 wherein said helical path is formed in a separate elongate guide element forming part of said elongate shank and said shank elements extend coaxially longitudinally outwardly from one end of said elongate guide element.

29. The expandable bit screw holding screwdriver claimed in claim 28 wherein said shank elements are linear.

30. The expandable bit screw holding screwdriver claimed in claim 29 wherein said second shaped aperture has a cross-sectional configuration similar to the cross-sectional configuration of said elongate guide element, and wherein said first shaped aperture is defined by a pair of adjacent, similarly formed, generally circular regions, each of said circular regions covering an arc of substantially more than 180°, but less than 360°, said regions joining at the terminal ends of their respective arcs.

* * * * *